US006261205B1

(12) United States Patent
Elefson

(10) Patent No.: US 6,261,205 B1
(45) Date of Patent: Jul. 17, 2001

(54) RESISTANCE TRAINING APPARATUS

(76) Inventor: Patrick M. Elefson, 5102 E. Piedmont #1291, Phoenix, AZ (US) 85044

( * ) Notice: Subject to any disclaimer, the term of this patent is extended or adjusted under 35 U.S.C. 154(b) by 0 days.

(21) Appl. No.: 09/335,079

(22) Filed: Jun. 17, 1999

(51) Int. Cl.[7] ..... A63B 21/06

(52) U.S. Cl. ..... 482/6; 482/9; 482/98; 482/135

(58) Field of Search ..... 482/6–9, 93, 94, 482/98, 99, 101, 104, 106, 135

(56) References Cited

U.S. PATENT DOCUMENTS 4,253,662 3/1981 Podolak .
4,799,672 1/1989 Barrett .
4,807,875 2/1989 Tanski .
5,314,394 5/1994 Ronan .
5,407,403 4/1995 Coleman .

*Primary Examiner*—John Mulcahy
(74) *Attorney, Agent, or Firm*—Parsons & Goltry; Michael W. Goltry; Robert A. Parsons

(57) ABSTRACT

Resistance training apparatus comprising a carriage mounted for movement along a reciprocally linear path, a load borne by the carriage and programmable drive apparatus that engages the carriage for bearing at least part of the load when a speed of the carriage meets or exceeds a maximum speed limit and meets or falls below a minimum speed limit.

29 Claims, 7 Drawing Sheets

100
101
103
103A
104
105
106
107
108
110
111
112
120
121
122
141
142
155
156
20
22
23
24
30
39
40
41
43
44
45

RESISTANCE TRAINING APPARATUS

FIELD OF THE INVENTION

This invention relates to programmable resistance training apparatus.

BACKGROUND OF THE INVENTION

Resistance training is important for increasing and maintaining muscle strength, and for increasing bone density. To maximize muscle development, it is necessary to repeatedly contract the muscles to failure along a full range of movement, contracting and stretching the muscle. At the point of failure, a spotter must aid the lifting party to complete a desired number of repetitions along a positive range of movement, which are commonly referred to as "forced repetitions." In addition to forced repetitions, negative or eccentric contractions are also important for maximizing muscle growth. Rather than moving against resistance, the negative or eccentric contraction is resisting a weight slowing moving against the muscle. Unlike positive movement, which facilitates muscle contraction, negative movement is a stretching of the muscle. Like forced repetitions, negative repetition requires a spotter to help the lifting party move the weight along the positive range of movement after each negative repetition. Optimum muscle growth is, therefore, best effected by a variable resistance-training regimen of forced and negative repetitions. Because most people train alone, finding a spotter to help with forced and negative repetitions is not always possible.

To solve this problem, skilled artisans have devised a variety of resistance training devices that provide assistance to the lifting party along the positive range of movement. Although adequate, known resistance training assist devices are difficult to construct, expensive and cumbersome. Accordingly, the continued need for new and useful improvements in the art of resistance training assist apparatus is evident.

Accordingly, it would be highly desirable to provide new and improved resistance training apparatus that provides assistance to a lifting party along positive and negative ranges of movement.

It is a purpose of the invention to provide new and improved resistance training apparatus that is easy to construct.

It is another purpose of the invention to provide new and improved resistance training apparatus that is relatively inexpensive.

It is still another purpose of the invention to provide new and improved resistance training apparatus that is easy to use.

It is a further purpose of the invention to provide new and improved resistance training apparatus that is programmable.

It is still a further purpose of the invention to provide new and improved resistance training apparatus that is safe.

It is yet still a further provision of the invention to enhance muscle development by providing a resistance training apparatus for automatically relieving resistance as needed to permit a user to complete positive and negative ranges of movement.

It is another purpose of the invention to provide new and improved resistance training apparatus that is dependable and adaptable depending on user needs.

It is still another provision of the invention to promote strength training.

It is yet still another provision of the invention to prevent muscle and skeletal injury as a result of improper or unsupervised resistance training.

SUMMARY OF THE INVENTION

The above problems and others are at least partially solved and the above purposes and others realized in new and improved resistance training apparatus comprising a carriage mounted for movement to a framework along a reciprocally linear path, a load borne by the carriage, and programmable drive apparatus that engages the carriage for assisting a user in moving the load along positive and negative ranges of movement when a speed of the carriage meets or exceeds a maximum speed limit and meets or falls below a minimum speed limit. At the instance the speed of the carriage meets or exceeds a maximum speed limit and/or meets or falls below a minimum speed limit, the resistance training apparatus may be programmed to completely free the user of the load. The load may be free or effected by the programmable drive apparatus. The programmable drive apparatus includes a drive assembly that engages the carriage, a motor coupled to the drive assembly, and controller apparatus coupled to actuate the motor to move the drive assembly in response to the speed of the carriage.

In a particular embodiment, the drive assembly includes a belt supported by drive and driven gears supported by the framework. The belt engages the carriage and the drive gear is coupled for movement in response to actuation of the motor. The motor includes a shaft that rotates during operation, and the drive gear is coupled to rotate in response to rotation of the shaft. The speed of the carriage along the reciprocally linear path can relate to a revolution rate of the motor's shaft. The controller apparatus includes a programmable controller/processor and sensor apparatus that tracks the speed of travel of the carriage along its reciprocal path. The sensor apparatus may comprise a rotation counter apparatus for tracking the revolution rate of the motor's shaft, or a linear counter apparatus for directly tracking the speed of the carriage as it moves along its reciprocal path. The controller/processor has storage capacity for receiving and storing programming data from an input. By engaging the input, a user may program the controller/processor with maximum and minimum speed limit data.

In a preferred embodiment, the carriage comprises a body having arms, and a handle supported by grips carried by the arms. The handle includes a length, and the grips are movable between inward and outward conditions for gripping the handle at different locations along its length.

BRIEF DESCRIPTION OF THE DRAWINGS

The foregoing and further and more specific objects and advantages of the invention will become readily apparent to those skilled in the art from the following detailed description taken in conjunction with the drawings in which.

DETAILED DESCRIPTION OF A PREFERRED EMBODIMENT

Figure 1:
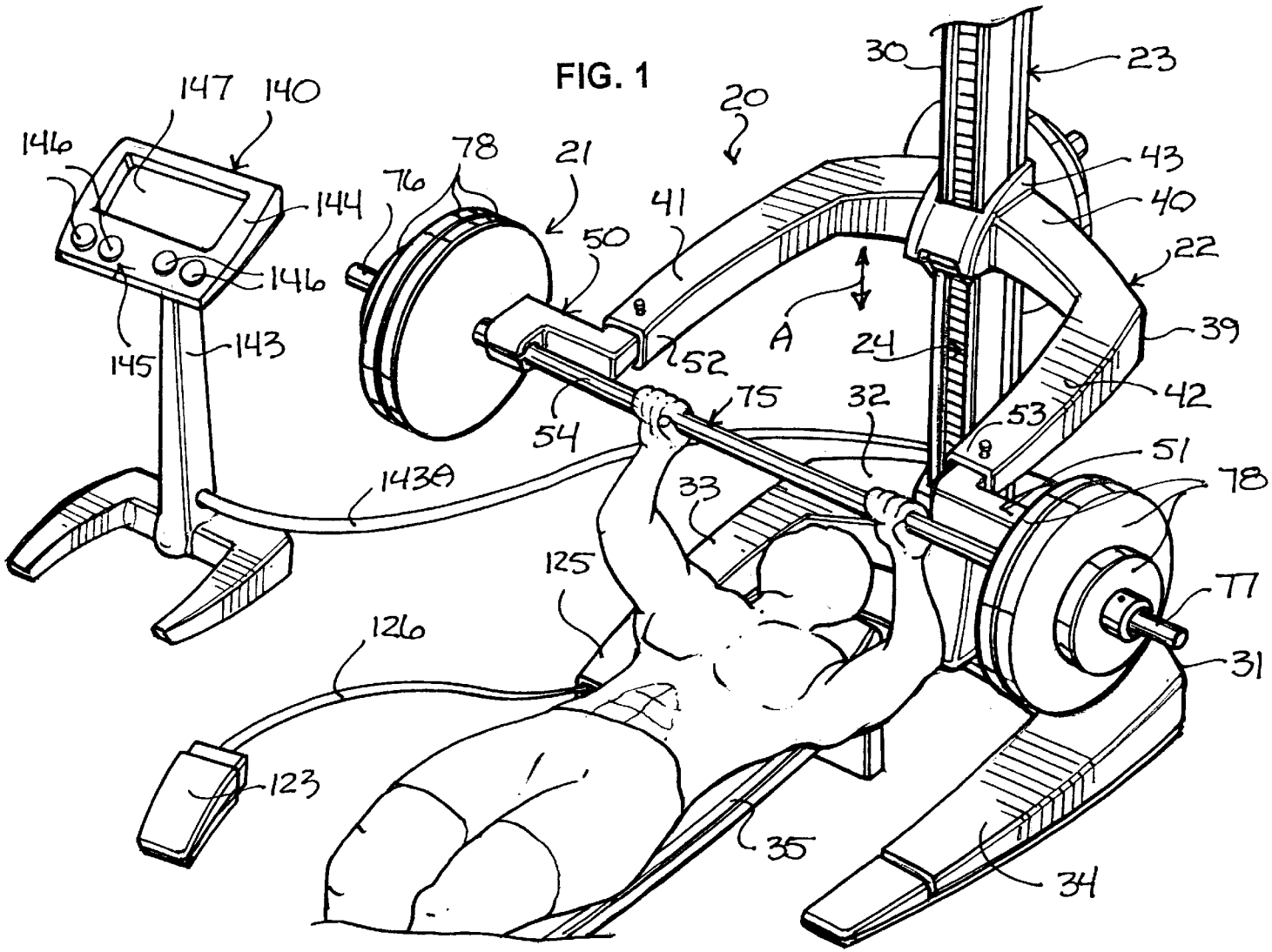
FIG. 1 is a perspective view of resistance training apparatus shown as it would appear in use, the resistance training apparatus comprising a load borne by a carriage mounted for movement to a framework along a reciprocally linear path, and drive apparatus that engages the carriage and assists a user in moving the load when a speed of the carriage meets or exceeds a maximum speed limit and meets or falls below a minimum speed limit.

This invention provides, among other things, new and improved resistance training apparatus for assisting a user or lifting party in accomplishing forced and negative repetitions. Turning to the drawings, in which like reference characters indicate corresponding elements throughout the several views, FIG. 1 illustrates a perspective view of resistance training apparatus 20 shown as it would appear in use, in accordance with the invention. Resistance training apparatus 20 is comprised four main elements including a (1) load 21 borne by a (2) carriage 22 mounted for movement to a (3) framework 23 along a reciprocally linear path indicated by the double arrowed line A, and (4) drive apparatus 24 that engages carriage 22 and assists a user in moving or resisting load 21 when a speed of carriage 22 along the reciprocally linear path meets or exceeds a predetermined maximum speed limit and meets or falls below a predetermined minimum speed limit. For clarity, §A presents a discussion of framework 23, §B presents a discussion of load 21 and carriage 22, §C presents a discussion of drive apparatus 24 and its associated electronic components and §D presents a discussion of the programming and operation of resistance training apparatus 20 followed by a brief presentation of optional programming features in §E.

§A. The Framework

Framework 23 is preferably constructed of steel, aluminum or the like, comprises the main support of the invention and may enjoy a wide variety of structural forms. In this embodiment, framework 23 evokes a stout countenance and, with additional reference to FIGS. 2 and 3, includes a column 30 carried by, and extending upwardly from, a base 31. Best shown in FIGS. 1 and 2, base 31 is generally U-shaped and includes a main portion 32 that leads to spaced-apart basal members 33 and 34. Column 30 and base 31 are hollow or otherwise define chambers for housing various components of the invention to be discussed in more detail later in this specification. The space between basal members 33 and 34 is sufficient to accommodate a user in a variety of different lifting exercises while standing, and a bench 35 (FIGS. 1–3) for allowing a user to lift in seated, inclined, declined and/or prone positions.

§B. The Load and Carriage

Figures 5, 6, 7, 8:
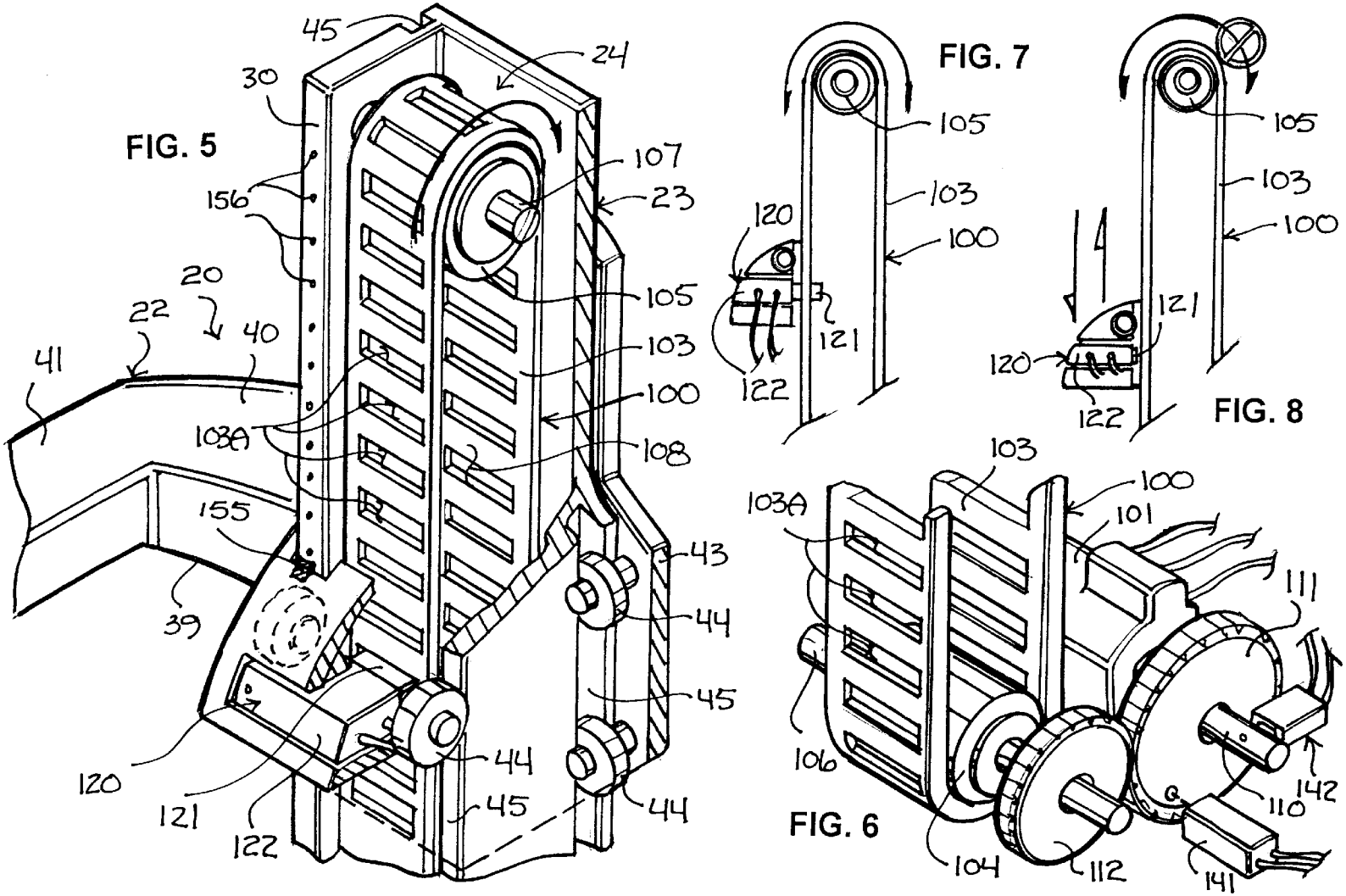
FIG. 5 is a fragmented perspective view of the drive apparatus of FIG. 1 and a latch that engages the carriage to the drive apparatus.
FIG. 6 is a perspective view of a motor engaged to a drive assembly, each comprising components of the drive apparatus.
FIG. 7 is a side view of the latch of FIG. 5, shown as it would appear engaged to the drive apparatus.
FIG. 8 is a side view of the latch of FIG. 5, shown as it would appear disengaged from the drive apparatus.

Carriage 22 is supported by column 30 for movement along a reciprocally linear path extending along substantially the entire length of column 30. Like framework 23, carriage 22 is rugged, stout and preferably constructed of steel, aluminum or the like. Regarding FIGS. 1 and 3, carriage 22 is generally U-shaped and is comprised of a body 39 including a main portion 40 that leads to spaced-apart arms 41 and 42 that are disposed in spaced-apart and substantially parallel relation in opposition to basal members 33 and 34. Carriage 22 defines a socket 43 at main portion 40 through which column 30 extends. Socket 43 captures column 30 and, as shown in FIG. 5, supports bearings, casters, sheaves or wheels 44 that mate with, and ride in, grooves 45 formed along substantially the entire length of column 30, which permits carriage 22 to move smoothly and reciprocally along column 30.

Figures 9, 10, 11:
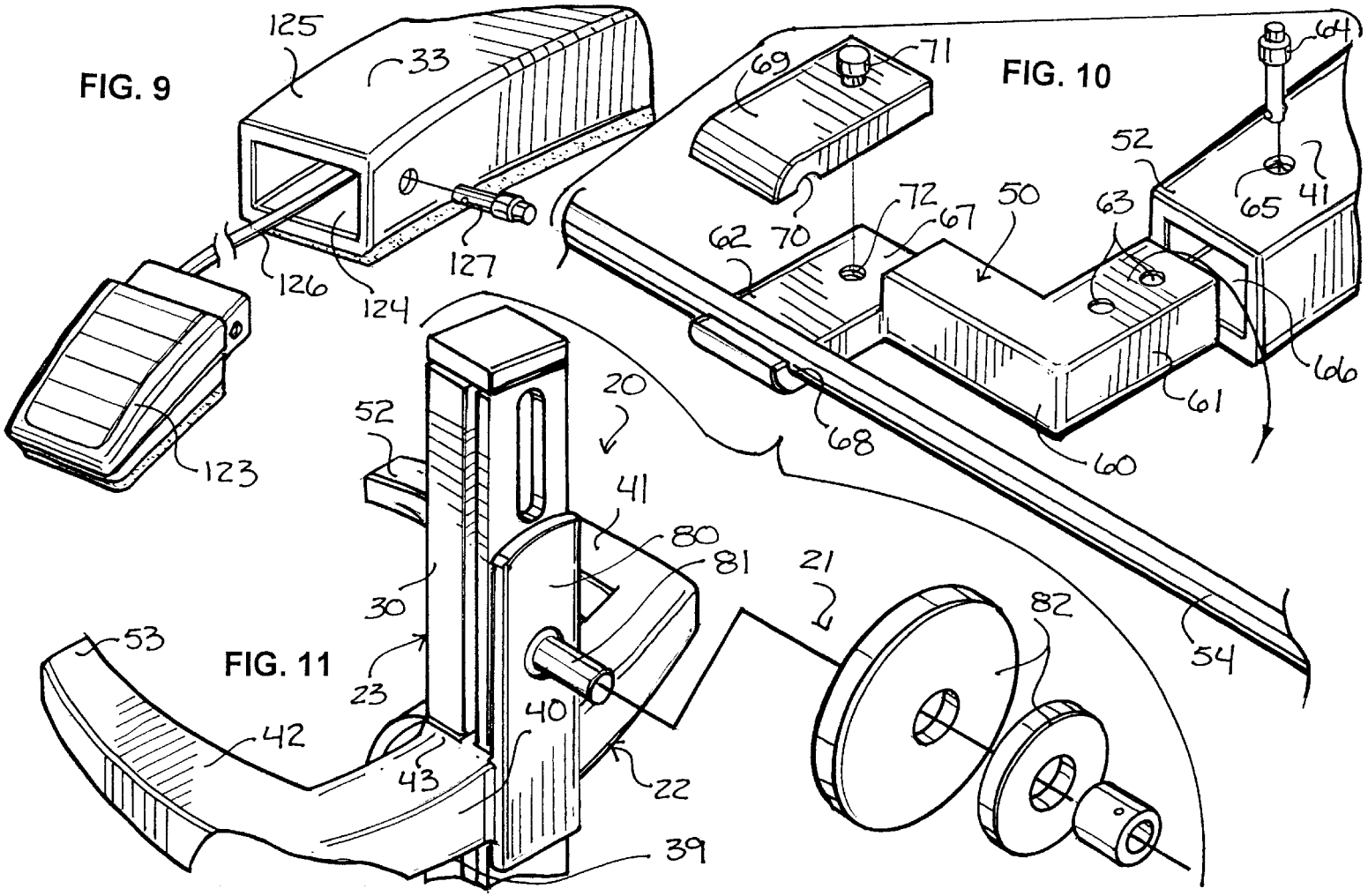
FIG. 9 is a fragmented perspective view of a switch for actuating the latch of FIG. 5.
FIG. 10 is an exploded fragmented perspective view of the carriage of FIG. 1.
FIG. 11 is a fragmented perspective view of resistance training apparatus of FIG. 1 showing a fixture supported by the carriage for accommodating free weight.

Turning back to FIG. 1, carriage 22 supports a handle 54. Handle 54 has a length and may be grasp or engaged by a user for moving load 21 during lifting exercise. Although handle may be fixed directly to arms 41 and 42, handle 54 is carried by grips 50 and 51 each housed partially in one of free ends 52 and 53 of arms 41 and 42, respectively. Grips 50 and 51 engage and support handle 54. Grips 50 and 51 are the mirror image of one another, and the structure of only one (grip 50) is shown in FIG. 10. Like grip 51, grip 50 comprises a generally Z-shaped body 60 having a proximal extremity 61 receivable partially into free end 52 of arm 41 and a distal extremity 62 spaced away laterally from proximal extremity 61. To secure body 60 to arm 41, proximal extremity 61 supports openings or apertures 63 each for accommodating a headed pin 64 that must first pass through an opening or aperture 65 extending through arm 41 adjacent its free end 52. Proximal extremity 61 is generally square in cross section and mates with socket 66 extending into arm 41 from its free end 52 which has a correspondingly square cross section. These square cross sections help prevent body 60 from twisting relative arm 41 when mounted into free end 52.

Distal extremity 62 defines a clamp portion 67 having a recess 68 that receives and accommodates handle 54. A complemental clamp portion 69 having a recess 70 is engagable to clamp portion 67 in a manner to capture and hold handle 54 in the recesses 68 and 70. A threaded bolt 71 carried by complemental clamp portion 69 is threadably engagable with a threaded aperture 72 carried by clamp portion 67 in a conventional manner, and secures clamp portions 67 and 69 together. Of course, other conventional fastening structure may be used. Clamp portions 67 and 69 cooperate as clamp apparatus.

Grips 50 and 51 can be mounted to arms 41 and 42, respectively, in either outward or inward conditions. In the outward condition shown in FIG. 1, the clamp apparatus of each grip 50 and 51 face away from each other defining a wide gripping orientation. In the inward condition, the clamp apparatus of each grip 50 and 51 face toward one another defining a narrow gripping orientation. By moving grips 50 and 51 between their wide and narrow gripping orientations, handle 54 can be gripped and supported at different locations along its length and, more particularly, at wide and narrow locations. Depending on how a user wishes to grip or otherwise engage handle 54 during a specific type of lifting exercise, the ability to secure handle 54 at wide and narrow grip locations gives the user this flexibility.

Figure 2:
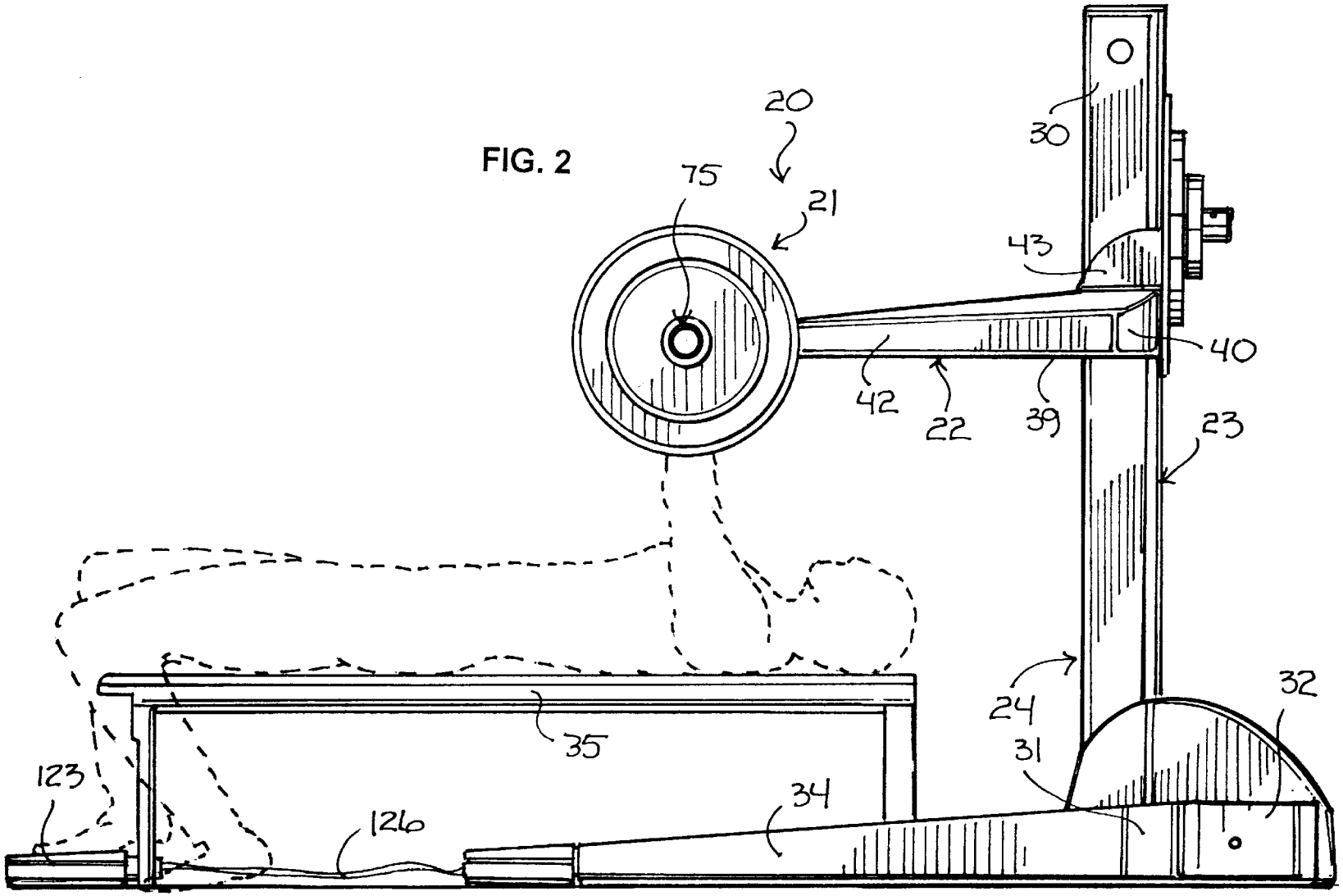
FIG. 2 is a side elevational view of the resistance training apparatus of FIG. 1, shown as it would appear in use.
Figure 3:
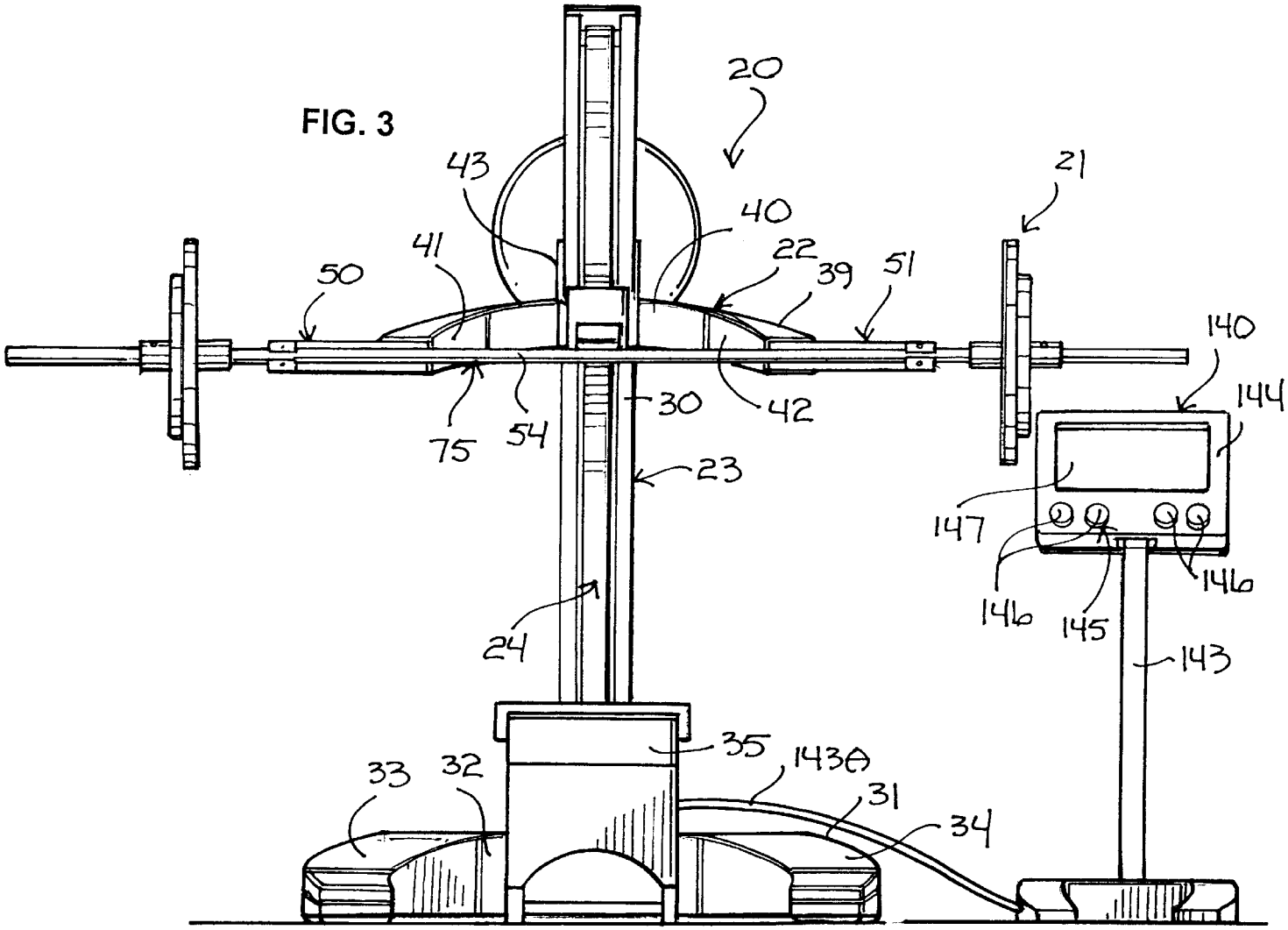
FIG. 3 is a front elevational view of the resistance training apparatus of FIG. 1.

In the embodiment shown in FIGS. 1–3, handle 54 comprises a portion of a conventional barbell 75 having free extremities 76 and 77 each for receiving and holding load 21 in the form of free weight provided here as plates 78 of varying weight. Carriage 22 also supports a structural support or fixture 80 that, as best seen in FIG. 11, rides along the back of column 30. Support 80 carries a free standing extension 81 for receiving and holding load 21 also in the form of free weight provided here as plates 82 of varying weight. Of course, carriage 22 may be constructed and arranged in a variety of manners suitable for accommodating load 21 in the form of free weight.

§C. The Drive Apparatus

Figure 4:
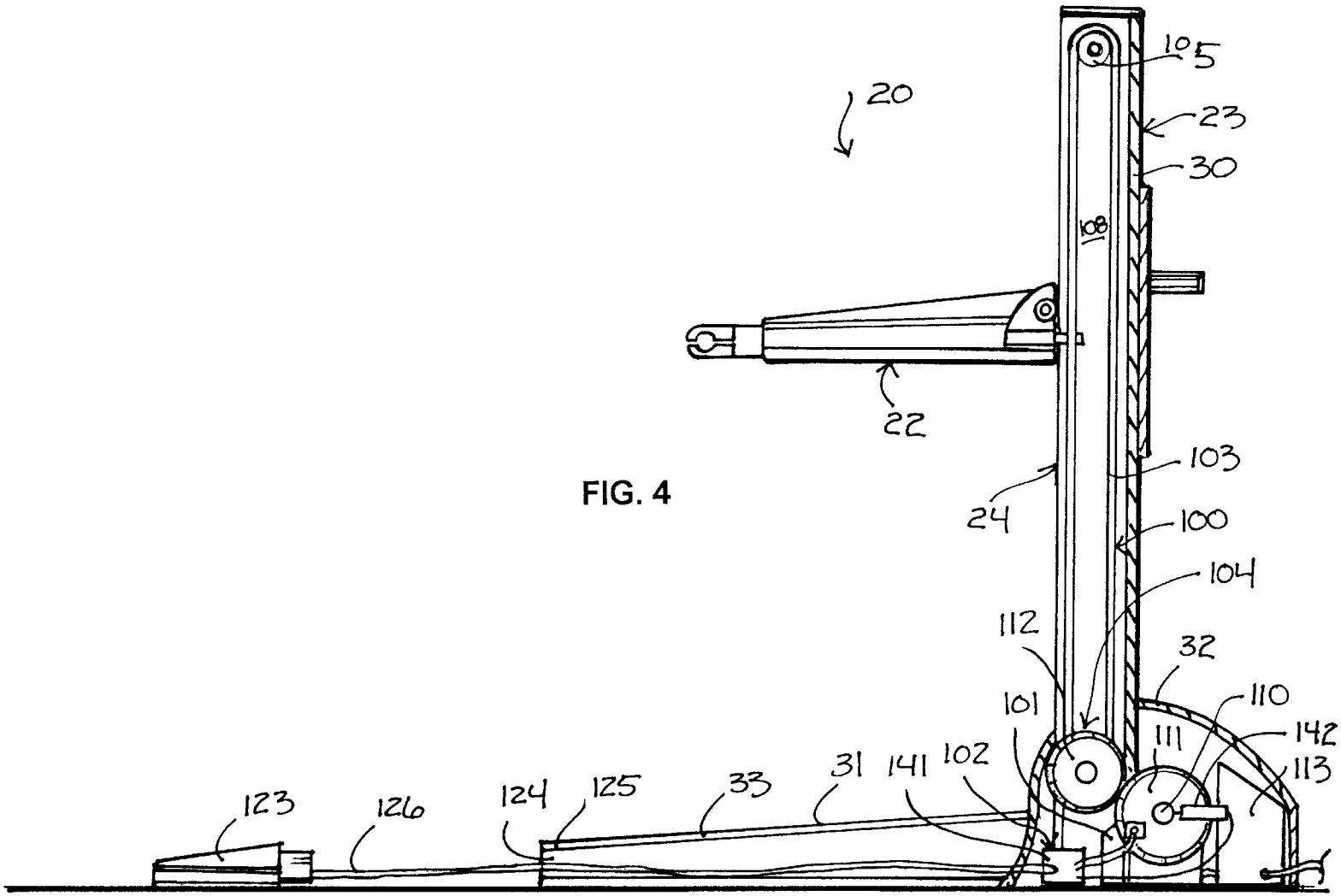
FIG. 4 is a vertical side sectional view of the resistance training apparatus of FIG. 1.

Depending on a predetermined set of operating conditions, drive apparatus 24 assists a user in moving load 21 during a positive or muscle-contracting range of movement and a negative or muscle-stretching range of movement. Turning to FIG. 4, drive apparatus 24 is comprised of three main parts including (1) a drive assembly 100, (2) a motor 101 coupled to drive assembly 100 and (3) controller apparatus 102 coupled to actuate motor 101 to move drive assembly 100 in response to a speed of carriage 22 along its reciprocally linear path. Drive assembly 100 is contained and supported in an open channel 108 defined by column 30. Open channel 108 runs substantially along column's 30 entire length. In this embodiment, drive assembly 100 is comprised of a belt 103 supported meshingly by drive and driven gears 104 and 105 (drive gear 104 shown only in FIG. 6). Drive and driven gears 104 and 105 each are mounted for rotation. Drive gear 104 is carried by a drive axle 106 supported by column 30, and driven gear 105 is carried by a driven axle 107 (FIG. 5) also supported by column 30. Drive gear 104 may be mounted to rotate with, or relative to, drive axle 106, and driven gear 105 may also be mounted to rotate with, or relative to, driven axle 107. Belt 103 is stout, rugged, continuous, supports slots 103A at spaced intervals along its entire length that mesh with the drive and driven gears 104 and 105, and is constructed of a flexible, high-strength elastomer, metallic linkages or elastomeric linkages, etc.

Regarding FIGS. 4 and 6, motor 101 is conventional, electrically powered, includes a shaft 110 that rotates during operation, contains clutch apparatus for empowering shaft to rotate in clockwise and counterclockwise directions and is housed within main portion 32 of framework 23. Shaft 110 supports a pinion 111 that constantly and meshingly engages a pinion 112 fixed to drive axle 105. When motor 101 actuates to rotate shaft 110, it causes drive gear 104 to rotate and drive belt 103 via power transfer from pinions 111 and 112. To supply electrical energy to motor 101, and to the other electrical components of drive apparatus 24, motor 101 is coupled in electrical communication either directly to a source of electrical power or to a battery 113 (FIG. 4), which is shown contained within main portion 32. Battery 113 preferably comprises a rechargeable 12-volt automotive or marine battery, etc. Because battery 43 is rechargeable, it is preferably coupled in electrical communication with a battery tender or charger 114 (shown only in FIG. 12) that is in turn coupled with a plug 115 (shown only in FIG. 12) engagable into a conventional electrical socket for allowing battery 113 to be recharged as needed. An exemplary battery tender useful in the present invention is one manufactured by Halon Mktg. USA, Inc., P.O. Box 203, Thorndale, Pa. 19372, that bears the exemplary trademark SUPERSMART™.

Notwithstanding the exemplary construction and arrangement constituting the drive assembly 100, it may embody other structural arrangements sufficient for transferring the rotational movement of motor 101 to linear movement along column 30. Yet, in order for drive apparatus 100 to offer a user at least partial respite from moving a load during a lifting exercise, whether along a positive or negative range of movement, carriage 22 must engage drive apparatus 100 and, more particularly, belt 103. Latch assembly 120 provides this engagement. Regarding FIG. 5, latch assembly 120 is contained by carriage 22 at main portion 40 in opposition to open channel 108 and belt 103. Latch assembly 120 is electrically powered and is comprised of a pin or latch 121 housed partially in a solenoid switch assembly 122 that when actuated, moves latch 121 between a retracted condition (FIG. 8) away from belt 103 and an extended condition toward, and engaged to, belt 103. In its extended condition in FIGS. 5 and 7, latch 121 admits into an opposing slot 103A, which facilitates engagement of carriage 22 to belt 103. To actuate solenoid switch assembly 122 to move latch 121 between its retracted and extended conditions, the invention includes toggle switch 123 shown in FIGS. 1, 2, 4 and 9. Switch 123 is intended to be actuated in response to pressure applied by the foot of a user when standing or while positioned on a bench such as bench 35. As shown best in FIG. 9, basal member 33 terminates away from main portion 32 with a socket 124 that extends inwardly from a free end 125. Regarding FIG. 4, switch 123 is tethered in electrical communication to latch assembly 120 by way of controller apparatus 102 with electrical interconnection 126, and may be accessed while extending freely away from free end 125 or while housed in socket 124 and secured therein with a pin 127. Electrical interconnection 126 passes to controller apparatus 102 through basal member 33, and through column 30 to latch assembly 120 from controller apparatus 102. Switch 123 can alternatively be associated with basal member 34 in much the same manner as basal member 33 or, perhaps, fixed or associated with framework 23 or carriage 22 at any desired and convenient location.

Figure 12:
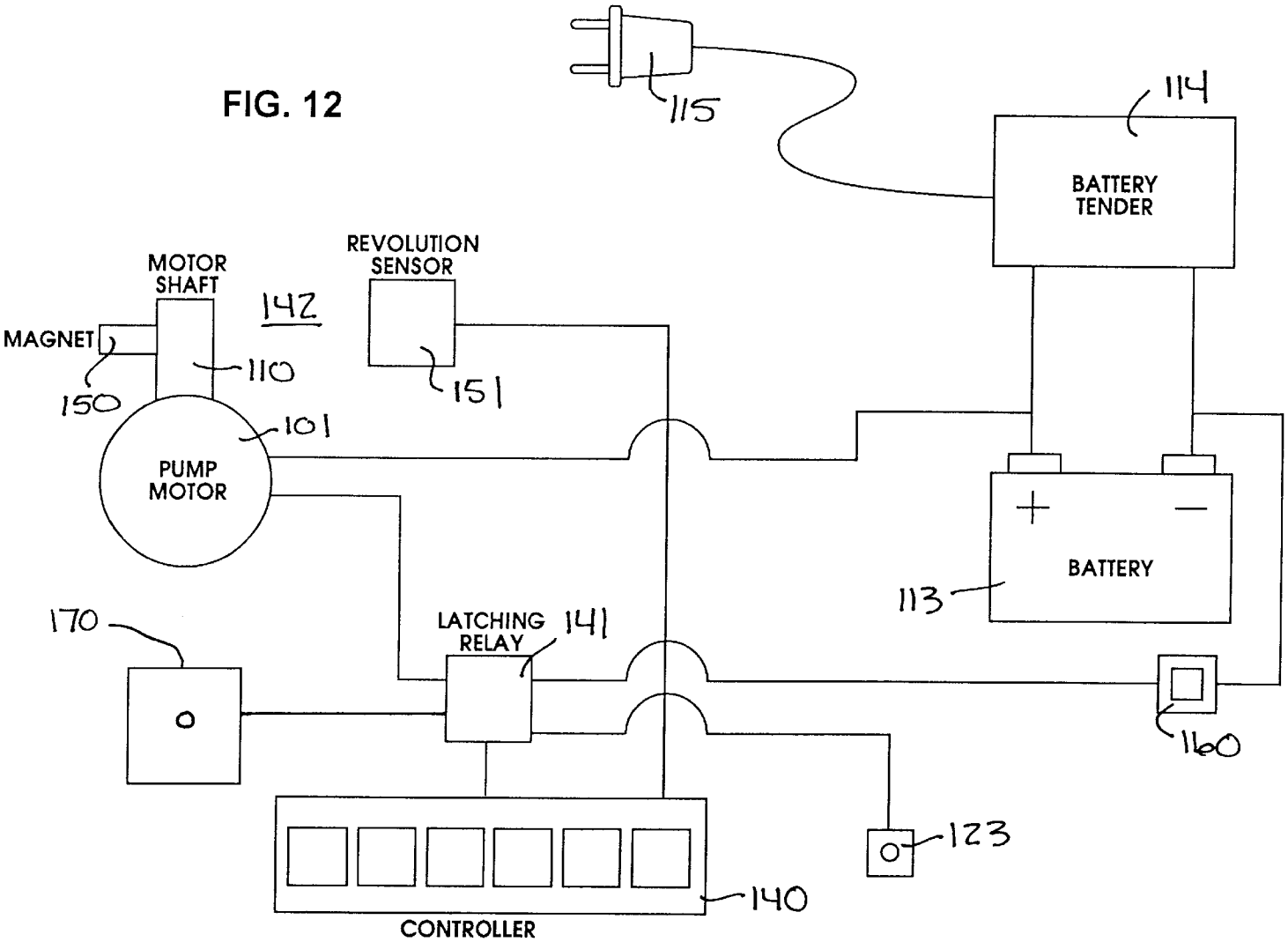
FIG. 12 is a schematic representation of controller apparatus for operating the resistance training apparatus of FIG. 1.

Turning to FIG. 12, controller apparatus 50 is comprised of a controller/processor 140, a conventional latching relay 141, sensor apparatus 142, motor 101 and switch 123, all of which are coupled in electrical, signal and data communication. Latching relay 141 is in electrical communication with battery 113 and motor 101. Controller/processor 140 is coupled in direct electrical and signal communication with sensor apparatus 142. As shown in FIGS. 1 and 3, controller/processor 140 is normally carried by a console 143 external to framework 23 which is coupled in electrical communication with the other electrical components of the invention via electrical interconnection 143A. Controller/processor 140 can be mounted directly to, or contained by, framework 23 if desired. Controller/processor 140 includes a control panel 144 having an input 145 in the form of buttons/keypads and readouts 146 that a user may engage for turning resistance training apparatus 20 ON and OFF and for programming controller/processor 140. A display 147 displays the operational characteristics and status of controller apparatus 102 and battery 113 voltage.

Controller/processor 140 includes electronic storage capacity and conventional logic/algorithmic circuitry for allowing it to be programmed and for allowing it to signal communicate with sensor apparatus 142 and relay 141. Sensor apparatus 142 operates to track the speed of carriage 22 as it moves along its reciprocal path and either continuously or intermittently communicate this speed data to controller/processor 140. In specific embodiments, sensor apparatus 142 may comprise (1) a rotation counter apparatus or (2) a linear counter apparatus. The rotation counter apparatus counts the revolutions of motor's 101 shaft 110 as it rotates during operation and communicates the revolution counting information or data to controller/processor 140 for display on display 147. With carriage 22 engaged to belt 103, each rotation of shaft 110 corresponds to a distance of carriage 22 travel along its reciprocal path in a given period of time which, of course, defines a speed of carriage 22 travel along its reciprocal path. The rotation counter apparatus includes a conventional magnetic 150 fixed to motor's 101 shaft 110 and a sensor 151 mounted adjacent shaft 110 in opposition to magnet 150. Magnet 150 is fixed to shaft with screws or other suitable fastener. As magnet 150 spins with the rotation of shaft 110, sensor 151 senses magnet 150 as it passes by and communicates that data to controller/processor 140, the rate and frequency of which corresponds to the carriage 22 travel speed.

The linear counter apparatus directly tracks the speed of carriage 22 along its reciprocal path and communicates this information or data to controller/processor 140 for display on display 147. Turning to FIG. 5, the linear counter apparatus includes a sensor 155 fixed to carriage 22 and conventional magnets 156 fixed to column 33 at spaced intervals along substantially its entire length in opposition to sensor 155. Sensor 155 and magnets 156 are each fixed in place with screws or other suitable fastener. As carriage 22 moves along its reciprocal path, sensor 155 senses magnets 156 as it passes by, and communicates this data to controller/processor 140, the rate and frequency of which corresponds directly to the speed of carriage 22 travel along column 30.

§D. Programming and Operation

Motor 101 contains conventional clutch apparatus for placing shaft 110 into a locked condition, a neutral or freely rotating condition, and a driving condition characterized by the rotational movement of shaft 110 at varying speeds in clockwise and counter clockwise directions. By way of latch assembly 120, carriage 22 is normally engaged to belt 103. Normally, then, carriage 22 is positioned along column 30 at a fixed position. To permit carriage 22 to move reciprocally along column 30, it must either be disengaged from belt 103, or motor 101 actuated for placing its shaft 110 into the neutral condition for allowing drive assembly 100 to move freely. Switch 123 is constructed and arranged such that upon application of a compressive force, will actuate latching relay 141 which will in turn actuate solenoid switch assembly 122 to disengage latch 121 from belt, or actuate motor 101 to place shaft 110 into the neutral condition. Only then may carriage 22 be moved reciprocally along column 30. As a user engages in a lifting exercise, it will be understood that the user moves carriage 22 repeatedly and reciprocally along column 30 between a first position away from base 31 and a second position toward base 31.

In operation, a user must first turn resistance training apparatus to its ON position for applying electrical power to the electrical components of the invention. At this point, the user may, by engaging keypads 146, program controller/processor 140 to effectuate drive assembly 100 to provide assistance to the user during a lifting exercise, whether in assisting the user in moving load 21 during a positive or muscle contracting range of movement or in resisting load 21 during a negative or muscle stretching range of movement. Programmed data is, of course, stored in, and accessed by, controller/processor 140. Should a user wish to engage in a concentric or positive resistance training exercise, the user may program controller/processor 140 with a minimum speed limit of carriage 22 as it will move along the positive or concentric range of movement. During concentric repetitions, should the speed of carriage 22, as sensed by either the rotation or linear counter apparatus, meet or fall below the minimum speed limit along a positive range of movement, controller/processor 140 will actuate latching relay 141 to actuate motor 101 to move drive assembly 100 for bearing load 21 borne by carriage 22 a least to a degree sufficient to keeping the speed of carriage 22 at or above the minimum speed limit. Should a user wish to engage in an eccentric or negative resistance training exercise, the user may program controller/processor 140 with a maximum speed limit of carriage 22 as it will move along the eccentric or negative range of movement. During eccentric repetitions, should the speed of carriage 22, as sensed by either the rotation or linear counter apparatus, meet or exceed the maximum speed limit, controller/processor 140 will actuate latching relay 141 to actuate motor 101 to cause drive assembly 100 to bear load 21 at least to a degree sufficient to keep the speed of carriage 22 at or below the maximum speed limit along the eccentric or negative range of movement.

At the instance the speed of carriage 22 meets or exceeds a maximum speed limit and/or meets or falls below a minimum speed limit, the resistance training apparatus 20 may be programmed to completely free the user of load 21. In this situation, controller/processor 140 will actuate latching relay 141 to actuate motor 101 to move drive assembly 100 to, if necessary, move carriage 22 away from the user, and place shaft 110 into its locked condition to locate carriage 22 at its fixed position.

As previously indicated, carriage 22 must be moved out of its fixed position by depressing switch 123 prior to beginning concentric or eccentric exercise. By engaging keypads 146, the user may program controller/processor 140 in different orientations such that in response to depressing switch 123, latching relay 141 will actuate for either (1) actuating solenoid switch assembly 122 to disengage latch 121 from belt, or (2) actuating motor 101 to place shaft 110 into the neutral condition. Regarding the former orientation, the linear counter apparatus will track and communicate carriage 22 speed data to controller/processor 140. At a point when assistance is required, controller/processor 140 actuates latching relay 141 to (1) actuate the solenoid switch assembly 122 to move latch 121 into engagement with belt 103, and (2) actuate motor 101 for driving its shaft 110 to cause drive assembly 100 to accommodate or bear load 21 at least to a degree sufficient to keep the speed of carriage at or above the minimum programmed speed limit or at or below the maximum programmed speed limit. Regarding the latter orientation, the linear counter apparatus and/or the rotation counter apparatus will track and communicate carriage 22 speed data to controller/processor 140. At a point when assistance is required, controller/processor 140 actuates latching relay 141 to actuate motor 101 for driving its shaft 110 to cause drive assembly 100 to accommodate or bear load 21 at least to a degree sufficient to keep the speed of carriage at or above the minimum programmed speed limit or at or below the maximum programmed speed limit. At the completion of a concentric or eccentric set of lifting repetitions, or at any time during a lifting exercise, the user may move carriage 22 into its fixed position by applying compressive force to switch 123 to actuate latching relay 141 to actuate (1) solenoid switch assembly 122 to move latch 121 into engagement with belt 103 if not already so, and motor 101 to move its shaft 110 into its locked condition.

§E. Optional Programming Features

Rather than loading carriage 22 with free weight, drive apparatus 100 may be configured to effectuate a desired load, which may be programmed into controller/processor 140 via keypads 146. As a result, a user may elect either free weight or programmable weight. A user may also program controller/processor 140 with a regimen of a predetermined number of concentric and/or eccentric sets each having a predetermined number of repetitions. The user may further program controller/processor 140 to activate and free the user of load 21 in the event he or she is not able to accomplish a programmed regimen or an arbitrary number of concentric and/or eccentric repetitions. Controller/processor 140 may also be configured to allow a user to program drop or raised sets with a programmed load, wherein each set has a repetition goal and a load either less or greater than a previous set.

The invention has been described above with reference to one or more preferred embodiments. However, those skilled in the art will recognize that changes and modifications may be made in the described embodiments without departing from the nature and scope of the invention. For instance, although switch 123 may be actuated for moving carriage out of its fixed position to column 30, carriage 22 may be equipped with a conventional pressure sensor apparatus 160 shown in FIG. 12 coupled in electrical communication to latching relay 141. As a user grips or engages handle 54, pressure sensor apparatus 160 is coupled so that in response to user pressure applied to carriage 22 through handle 54, pressure sensor 160 will actuate latching relay 141 which will in turn actuate solenoid switch assembly 122 to disengage latch 121 from belt 103. The invention may further include carriage set switch 170 shown in FIG. 12 coupled in electrical communication to latching relay 141. Carriage set switch 170 may be user engaged for moving carriage 22 up and down along column 30 to any desired fixed position depending on user needs. In response to engagement of carriage set switch 170, whether for moving carriage 22 up or down along column, latching relay 141 will actuate to in turn actuate motor 101 to move drive assembly 100 to effectuate movement of carriage 22 along column 30 to a desired position. When the carriage 22 has reached a desired location along column 30, the user may disengage carriage set switch 170 to lock carriage 22 in place.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. Resistance training apparatus comprising:

a carriage mounted for movement along a reciprocally linear path;

a load borne by the carriage;

drive apparatus for conditionally bearing at least part of the load; and a latch mounted on the carriage and movable between a first condition engaging the carriage to the drive apparatus and a second condition disengaging the carriage from the drive apparatus;

wherein the drive apparatus is capable of acting on the carriage when the latch is in the first condition to bear at least part of the load; and controller apparatus for controlling the latch based on the movement of the carriage.

2. Resistance training apparatus of claim 1, wherein the carriage is supported by a framework.

3. Resistance training apparatus of claim 1, wherein the drive apparatus includes:

a motor coupled to a drive assembly; and controller apparatus for actuating the motor to move the drive assembly.

4. Resistance training apparatus of claim 3, wherein the drive assembly includes a belt supported by a drive gear drivingly coupled to the motor and a driven gear.

5. Resistance training apparatus of claim 4, the motor including a drive shaft, wherein the drive gear is coupled to drive shaft.

6. Resistance training apparatus of claim 1, wherein the load is free.

7. Resistance training apparatus of claim 1, wherein the drive apparatus provides the load.

8. Resistance training apparatus of claim 1, wherein the carriage comprises:

a body having first and second arms; and a handle supported by first and second grips each carried by one of the first and second arms.

9. Resistance training apparatus of claim 8, the handle having a length, wherein the first and second grips are movable between inward and outward conditions for gripping the handle at different locations along its length.

10. Resistance training apparatus comprising:

a carriage mounted for movement along a reciprocally linear path between first and second positions;

a load borne by the carriage;

drive apparatus for conditionally bearing at least part of the load;

a latch mounted on the carriage and movable between a first condition engaging the carriage to the drive apparatus and a second condition disengaging the carriage from the drive apparatus; and controller apparatus for controlling the latch based on the movement of the carriage;

wherein in the first condition of the latch, the drive apparatus bears at least part of the load when a speed of the carriage meets or exceeds a maximum speed limit between the first and second positions and meets or falls below a minimum speed limit between the first and second positions.

11. Resistance training apparatus of claim 10, wherein the carriage is supported by a framework.

12. Resistance training apparatus of claim 10, wherein the drive apparatus includes:

a motor coupled to a drive assembly; and programmable controller apparatus for actuating the motor to move the drive assembly.

13. Resistance training apparatus of claim 12, wherein the drive assembly includes a belt supported by a drive gear drivingly coupled to the motor and a driven gear.

14. Resistance training apparatus of claim 13, the motor including a drive shaft, wherein the drive gear is coupled to drive shaft.

15. Resistance training apparatus of claim 14, the speed of the carriage along the reciprocally linear path relating to a revolution rate of the drive shaft, the controller apparatus including a programmable processor and sensor apparatus for counting the revolution rate of the drive shaft and one of constantly and intermittently communicating the revolution rate to the programmable processor.

16. Resistance training apparatus of claim 10, wherein the load is free.

17. Resistance training apparatus of claim 10, wherein the drive apparatus provides the load.

18. Resistance training apparatus of claim 10, wherein the carriage comprises:

a body having first and second arms; and a handle supported by first and second grips each carried by one of the first and second arms.

19. Resistance training apparatus of claim 18, the handle having a length, wherein the first and second grips are movable between inward and outward conditions for gripping the handle at different locations along its length.

20. Resistance training apparatus comprising:

a framework;

drive apparatus carried by the framework;

a load borne by a carriage mounted to the framework for movement along a reciprocally linear path;

a latch mounted on the carriage and movable between a first condition engaging the carriage to the drive apparatus and a second condition disengaging the carriage from the drive apparatus;

a switch for moving the latch between the first condition so that the drive apparatus bears at least part of the load and the second condition; and controller apparatus for controlling the switch based on the movement of the carriage.

21. Resistance training apparatus of claim 20, wherein the drive apparatus includes:

a motor coupled to a drive assembly; and controller apparatus for actuating the motor to move the drive assembly.

22. Resistance training apparatus of claim 21, wherein the drive assembly includes a belt supported by a drive gear drivingly coupled to the motor and a driven gear.

23. Resistance training apparatus of claim 21, wherein the controller apparatus includes:

a sensor assembly for measuring the speed of the carriage along the reciprocally linear path; and a processor for actuating the switch for moving the latch from its second condition to its first condition and for actuating the motor to move the drive assembly in response to the speed of the carriage.

24. Resistance training apparatus of claim 23, the processor having storage capacity, further including an input coupled to the processor for receiving maximum and minimum speed limit data and communicating the maximum and minimum speed limit data to the processor for storage.

25. Resistance training apparatus of claim 20, wherein the load is free.

26. Resistance training apparatus of claim 20, wherein the drive apparatus provides the load.

27. Resistance training apparatus of claim 20, wherein the carriage comprises:

a body having first and second arms; and a handle supported by first and second grips each carried by one of the first and second arms.

28. Resistance training apparatus of claim 27, the handle having a length, wherein the first and second grips are movable between inward and outward conditions for gripping the handle at different locations along its length.

29. Resistance training apparatus of claim 20, wherein the switch is adapted and arranged to actuate in response to pressure applied to the carriage.

* * * * *